US009869000B2

(12) United States Patent
Bakas et al.

(10) Patent No.: US 9,869,000 B2
(45) Date of Patent: Jan. 16, 2018

(54) METHODS OF MAKING BAINITIC STEEL MATERIALS

(71) Applicant: Battelle Energy Alliance, LLC, Idaho Falls, ID (US)

(72) Inventors: Michael Paul Bakas, Idaho Falls, ID (US); Henry Shiu-Hung Chu, Idaho Falls, ID (US); Thomas Andrew Zagula, Rigby, ID (US); Benjamin Robert Langhorst, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 401 days.

(21) Appl. No.: 14/566,455

(22) Filed: Dec. 10, 2014

(65) Prior Publication Data

US 2016/0348200 A1 Dec. 1, 2016

Related U.S. Application Data

(60) Provisional application No. 61/914,189, filed on Dec. 10, 2013.

(51) Int. Cl.
*C21D 1/20* (2006.01)
*C21D 1/607* (2006.01)
(Continued)

(52) U.S. Cl.
CPC ..... *C21D 1/34* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 3,658,602 A * 4/1972 Pomey ..... C21D 1/56 148/121
5,064,479 A * 11/1991 Van den Sype ..... C21D 1/62 148/605
(Continued)

FOREIGN PATENT DOCUMENTS

JP 354079119 A * 6/1979 ..... C21D 9/52

OTHER PUBLICATIONS

Avishan, Behzad. et al., "Retained Austenite Thermal Stability in a Nanostructured Bainitic Steel" Faculty of Materials Engineering, Sahand University of Technology, Tabriz, Iran, 2013, 15 pages.
(Continued)

*Primary Examiner* — Deborah Yee
(74) *Attorney, Agent, or Firm* — TraskBritt

(57) ABSTRACT

Methods of making bainitic steels may involve austenitizing a quantity of steel by exposing the quantity of steel to a first temperature. A composition of the quantity of steel may be configured to impede formation of non-bainite ferrite, pearlite, and Widmanstätten ferrite. The quantity of steel may be heat-treated to form bainite by exposing the quantity of steel to a second, lower temperature. The second, lower temperature may be stabilized by exposing the quantity of steel to the second, lower temperature in the presence of a thermal ballast.

10 Claims, 4 Drawing Sheets

(51) Int. Cl.

| | |
|---|---|
| ***C21D 1/84*** | (2006.01) |
| ***C21D 1/34*** | (2006.01) |
| ***C21D 6/00*** | (2006.01) |
| ***C22C 38/30*** | (2006.01) |
| ***C22C 38/22*** | (2006.01) |
| ***C22C 38/06*** | (2006.01) |
| ***C22C 38/04*** | (2006.01) |
| ***C22C 38/02*** | (2006.01) |

(52) U.S. Cl.

CPC ..... *C22C 38/02* (2013.01); *C22C 38/04* (2013.01); *C22C 38/06* (2013.01); *C22C 38/22* (2013.01); *C22C 38/30* (2013.01); *C21D 2211/002* (2013.01)

(56) References Cited

U.S. PATENT DOCUMENTS

| | | | | |
|---|---|---|---|---|
| 6,149,743 | A | 11/2000 | Lund et al. | |
| 2006/0060268 | A1 | 3/2006 | Machrowicz et al. | |
| 2011/0126946 | A1 | 6/2011 | Bhadeshia et al. | |
| 2013/0167983 | A1* | 7/2013 | Clarke | C21D 6/005 148/541 |

OTHER PUBLICATIONS

Bhadeshia, Harry, "Super Strong Super Bainite", Professor Harry Bhadeshia, University of Cambridge, Jul. 10, 2012, 2 pages.

Fielding, Lucy, "The Bainite Controversy", Materials Science and Technology, vol. 29, Apr. 2013, pp. 383-399.

Huang H. et al., "Combinatorial Optimisation of Carbide-Free Bainitic Nanostructures" SKF University Technology Centre, Department of Materials Science and Metallurgy, University of Cambridge, 2013, 22 pages.

* cited by examiner

METHODS OF MAKING BAINITIC STEEL MATERIALS

CROSS-REFERENCE TO RELATED APPLICATION

This application claims the benefit of U.S. Provisional Patent Application Ser. No. 61/914,189, filed Dec. 10, 2013, and titled, "BAINITIC STEEL MATERIALS AND METHODS OF MAKING SUCH MATERIALS," the disclosure of which is incorporated herein in its entirety by this reference.

STATEMENT REGARDING FEDERALLY-SPONSORED RESEARCH OR DEVELOPMENT

This invention was made with government support under Contract Number DE-AC07-05ID14517 awarded by the United States Department of Energy. The government has certain rights in the invention.

FIELD

This disclosure relates generally to steel materials and methods of making steel materials. More specifically, disclosed embodiments relate to compositions of bainitic steel materials and methods of making bainitic steel materials that may increase the reliability with which, and reduce the cost at which, bainitic steel materials may be obtained.

BACKGROUND

Bainite has been a known phase of steel since at least 1930. However, the formation of bainite frequently involved the undesirable precipitation of carbides and the formation of brittle cementite. Recently, however, some techniques for suppressing the formation of such undesirable carbides have been developed. For example, Behzad Avishan et al., *Retained Austenite Thermal Stability in a Nanostructured Bainitic Steel,* 81 Materials Characterization 105 (2013) describes a bainitic steel composition including 0.91% by weight carbon, 1.58% by weight silicon, 1.98% by weight manganese, 0.06% by weight nickel, 0.25% by weight molybdenum, 1.12% by weight chromium, 1.37% by weight cobalt, and 0.53% by weight aluminum, with the balance being iron. After austenitizing, the samples are transferred to a salt bath for heat treatment. The samples are then quenched in water, resulting in the described bainitic steel.

BRIEF SUMMARY

In some embodiments, bainitic steel materials may include between 0.62% and 0.78% by weight carbon, between 1.5% and 2.5 % by weight silicon, between 1.75% and 2.5% by weight manganese, between 0.22 % and 0.5% by weight molybdenum, between 1.0% and 1.8% by weight chromium, between 0.0% and 0.3% by weight cobalt, between 0.25% and 1.0% by weight aluminum, and the balance consisting essentially of iron.

In other embodiments, methods of making bainitic steels may involve austenitizing a quantity of steel by exposing the quantity of steel to a first temperature. A composition of the quantity of steel may be configured to impede formation of non-bainite ferrite, pearlite, and Widmanstätten ferrite during cooling. The quantity of steel may be heat-treated to form bainite by cooling the quantity of steel from the first temperature and exposing the quantity of steel to a second, lower temperature, to which the quantity of steel may remain exposed for a prolonged period. The second, lower temperature may be stabilized by exposing the quantity of steel to the second, lower temperature in the presence of a thermal ballast. The quantity of steel may be permitted to cool.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to limit the scope of the disclosure to any particular embodiment, but are merely employed to describe illustrative embodiments. Thus, at least some of the drawings are not necessarily to scale and may be idealized representations, rather than actual views of a particular embodiment.

Disclosed embodiments relate generally to compositions of bainitic steel materials and methods of making bainitic steel materials that may increase the reliability with which, and reduce the cost at which, bainitic steel materials may be obtained.

Figure 1:
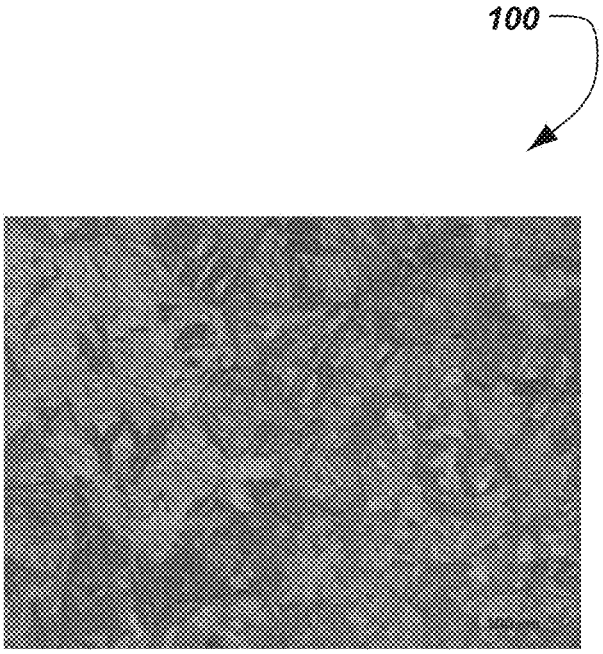
FIG. 1 is a photomicrograph of a bainitic steel material.

Referring to FIG. 1, a photomicrograph of a bainitic steel material 100 is shown. The bainitic steel material 100 may include a principal phase of bainite with austenite in solid suspension interspersed throughout the bainite phase. More specifically, the bainitic steel material 100 may include nanoscale bainitic ferrites in a matrix of carbon-enriched austenite. The austenite may occupy between about 10% and about 20% by volume of the bainitic steel material 100. The balance of the bainitic steel material 100 may consist essentially of bainite, although some residual phases of steel, such as, for example, martensite, may be present. When it is said that the balance "consists essentially of" bainite, what is meant is that some small quantities (e.g., less than 5% by volume) of the bainitic steel material 100 may inherently form phases other than bainite and austenite when forming the bainitic steel material 100 using the method 102 described in connection with FIGS. 2 and 3, but the composition of the bainitic steel material 100 and the acts of the method 102 are specifically directed to forming austenitic and bainitic phases. For example, the quantity of cementite in the bainitic steel material 100 may be suppressed by alloying elements of the bainitic steel material 100.

The composition of the bainitic steel material 100 may be configured to impede formation of non-bainite ferrite, pearlite, and Widmanstätten ferrite phases while reducing the inclusion of expensive elements. For example, the bainitic steel material 100 may include between 0.62% and 0.78% (e.g., 0.7%) by weight carbon. The bainitic steel material 100 may include, for example, between 1.5% and 2.5% (e.g., 1.9%) by weight silicon, which may impede the growth of non-bainite phases. The bainitic steel material 100 may include, for example, between 1.75% and 2.5% (e.g., 2%) by weight manganese. The bainitic steel material 100 may include, for example, between 0.22% and 0.5% (e.g., 0.25%) by weight molybdenum. The bainitic steel material 100 may include, for example, between 1.0% and 1.8% (e.g., 1.4%) by weight chromium. The bainitic steel material 100 may include, for example, between 0.0% and 0.3% (e.g., 0.15%) by weight cobalt. The bainitic steel material 100 may include, for example, between 0.25% and 1.0% (e.g., 0.75%) by weight aluminum. The balance of the bainitic steel material 100 may consist essentially of, for example, iron. When it is said that the balance of the bainitic steel material 100 "consists essentially of" iron, what is meant is that iron may be the only other element deliberately included in the bainitic steel material 100, though contaminants may be inevitably present in the bainitic steel material 100. In some embodiments, the bainitic steel material 100 may consist entirely of the foregoing elements in their described quantities, plus any contaminants unavoidably introduced into the bainitic steel material 100 during formation. The bainitic steel material 100 may lack some relatively expensive elements conventionally included in steel materials. For example, the bainitic steel material 100 may be free of nickel, vanadium, or both.

The bainitic steel material 100 may exhibit high hardness throughout the bainitic steel material 100. For example, the bainitic steel material 100 may exhibit an at least substantially uniform high hardness throughout the bainitic steel material 100. More specifically, the bainitic steel material 100 may exhibit a hardness of at least about 50 HRC. As a specific, nonlimiting example, the bainitic steel material 100 may exhibit a hardness of at least about 53 HRC (e.g., between about 56 HRC and about 60 HRC or greater) on the Rockwell C hardness scale. The bainitic steel material 100 may exhibit at least substantially uniform hardness even throughout a massive quantity of the bainitic steel material. For example, the bainitic steel material 100 may exhibit at least substantially uniform hardness throughout at least a 4-inch by 4-inch by 0.75-inch plate. More specifically, the bainitic steel material may exhibit at least substantially uniform hardness throughout at least an 8-inch by 10-inch by 1-inch plate (e.g., throughout a 10-inch by 12-inch by 1.5-inch plate or larger). The bainitic steel material 100 may be strong, exhibiting a high yield strength. For example, the yield strength exhibited by the bainitic steel material 100 may be greater than about 1.0 GPa. More specifically, the yield strength exhibited by the bainitic steel material 100 may be greater than about 1.25 GPa (e.g., greater than about 1.5 GPa). In addition, the bainitic steel material 100 may exhibit a high ultimate tensile strength. For example, the ultimate tensile strength exhibited by the bainitic steel material 100 may be greater than about 1.5 GPa. More specifically, the ultimate tensile strength exhibited by the bainitic steel material 100 may be greater than about 1.75 GPa (e.g., greater than about 2 GPa). The bainitic steel material 100 may exhibit some ductility. For example, a maximum strain at failure exhibited by the bainitic steel material may be about 2.5% or greater. More specifically, the maximum strain at failure exhibited by the bainitic steel material may be, for example, about 3% or greater. As a specific, nonlimiting example, the maximum strain at failure exhibited by the bainitic steel material 100 may be about 4% or greater (e.g., about 4.7% or greater). An elastic modulus of the bainitic steel material 100 may be, for example, between about 175 GPa and about 225 GPa. More specifically the elastic modulus exhibited by the bainitic steel material 100 may be between about 190 GPa and about 210 GPa (e.g., about 200 GPa).

Figure 2:
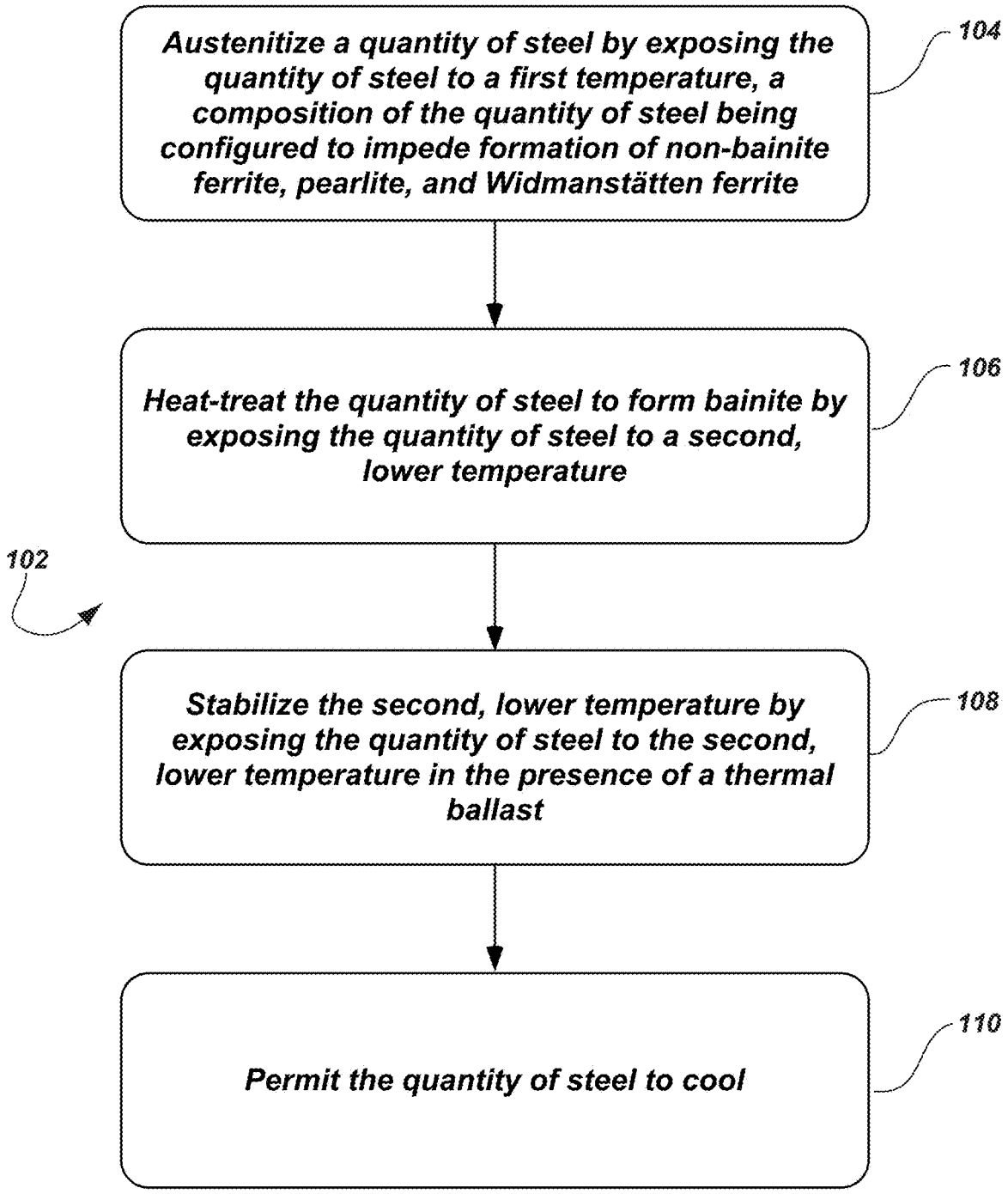
FIG. 2 is a flowchart diagram of a method of forming the bainitic steel material of FIG. 1.

Referring to FIG. 2, a flowchart diagram of a method 102 of forming the bainitic steel material 100 of FIG. 1 is shown. The method 102 may involve austenitizing a quantity of steel by exposing the quantity of steel to a first temperature, as shown at 104. For example, the quantity of steel may be austenitized by exposing the quantity of steel to a temperature between about 700° C. and about 1,100° C. (e.g., about 1,000° C.). The quantity of steel may remain exposed to the first temperature for sufficient time to austenitize, for example, the entire quantity of steel. More specifically, the quantity of steel may remain exposed to the first temperature, for example, for between about 30 minutes and about 1 hour (e.g., about 45 minutes), depending on the mass of the quantity of steel material. A crystalline structure of the quantity of steel may change from body-centered cubic to face-centered cubic. A thermocouple (e.g., a type K, type N, type B, type R, type C, or type M thermocouple) and a processor (e.g., a dedicated tracker for the quantity of steel or a control unit of a furnace) may be used to monitor and control the temperature to which the quantity of steel is exposed (e.g., in a furnace). The composition of the quantity of steel may be configured to impede formation of non-bainite ferrite, pearlite, and Widmanstätten ferrite. For example, the composition of the quantity of steel may include the elements in their respective volume percentages discussed previously in connection with FIG. 1.

In some embodiments, the quantity of steel may be cast from its constituent elements before austenitizing the quantity of steel. For example, the constituent elements, or alloys containing the constituent elements, in amounts selected to achieve the desired volume percentage of respective elements in the resulting bainitic steel material 100 (see FIG. 1), may be liquefied together at high temperature (e.g., above 1,400° C.), poured into a mold, and actively cooled, allowed to cool, or cooled through a controlled reduction in temperature. In some embodiments, the shape of the mold may be selected to impart a desired shape to the resulting quantity of steel. When cooling from the original casting, the resulting quantity of steel may not be compositionally homogeneous because of alloy segregation that may occur as different portions of the steel solidify before others. In some embodiments, the quantity of steel may be homogenized before austenitizing the quantity of steel. For example, the quantity of steel may be exposed to an elevated temperature (e.g., greater than about 1,000° C., such as, for example, between about 1,150° C. and about 1,200° C.), and exposure to the elevated temperature may be maintained to permit the constituent elements of the quantity of steel to diffuse and create a more uniform composition throughout the quantity of steel. For example, the quantity of steel may remain exposed to the elevated temperature for between about 24 hours and about 60 hours (e.g., between about 30 hours and about 48 hours) to homogenize the quantity of steel.

After austenitizing the quantity of steel, the quantity of steel may be permitted to cool. For example, the quantity of steel may be permitted to cool to a temperature of between about 300° C. and about 500° C. (e.g., about 400° C.). The cooling may not be assisted or hastened by liquid quenching techniques (e.g., salt baths and water quenching). For example, the quantity of steel may be subjected to a controlled cooling process by gradually lowering the temperature of a furnace, may be air-cooled by turning of the furnace, or may be air-cooled by removing the quantity of steel from the furnace and leaving it to cool while exposed to room temperature. As a specific, nonlimiting example, the quantity of steel may be permitted to cool in the furnace to about 800° C. (e.g., by gradually reducing temperature under control of a process or by turning of the furnace), and may be air-cooled from about 800° C. to about 400° C. by removing the quantity of steel from the furnace and exposing it to room temperature. A thermocouple and a processor (e.g., a dedicated tracker for the quantity of steel) may be used to monitor and control the temperature to which the quantity of steel is cooled.

The quantity of steel may be heat-treated to form bainite by exposing the quantity of steel to a second, lower temperature, as shown at 106. For example, the quantity of steel may be exposed to a temperature of between about 175° C. and about 300° C. to induce the formation of a bainite microstructure within the quantity of steel. More specifically, the quantity of steel may be exposed to a temperature of between about 200° C. and about 250° C. (e.g., about 225° C.) to induce a formation of a principal phase of bainite with austenite and some other residual phases of steel in solid suspension interspersed throughout the principal phase of bainite. The quantity of steel may remain exposed to the second, lower temperature for a time sufficient to transform a majority of the microstructure of the quantity of steel to bainite. For example, the quantity of steel may remain exposed to the second, lower temperature for about 2 days or more. More specifically, the quantity of steel may remain exposed to the second, lower temperature for about 3 days or more (e.g., at least about 4 days). As another example, the quantity of steel may remain exposed to the second, lower temperature until the austenite phase occupies between about 10% and about 20% by volume of the quantity of steel and a remainder of the quantity of steel consists essentially of bainite. In some embodiments, the austenite and bainite content of the quantity of steel may be measured after heat-treating the quantity of steel, such as, for example, using x-ray diffraction.

The second, lower temperature may be stabilized by exposing the quantity of steel to the second, lower temperature in the presence of a thermal ballast, as shown at 108. For example, the thermal ballast may reduce the extent to which the second, lower temperature is raised as a result of introducing the hot quantity of steel into the environment in which the second, lower temperature is maintained (e.g., a furnace) when compared to the extent to which the second, lower temperature would be raised absent the thermal ballast (e.g., in the presence of air or another gaseous environment). More specifically, the thermal ballast may maintain the actual temperature of the environment in which the second, lower temperature is maintained within about 60% of the desired, second, lower temperature (e.g., within about 50% of the desired, second lower temperature). As a specific, nonlimiting example, the thermal ballast may maintain the actual temperature of the environment in which the second, lower temperature is maintained within about 150° C. of the desired, second, lower temperature (e.g., within about 100° C. of the desired, second lower temperature).

The thermal ballast may be a solid material such that the method 102 is performed without contacting the quantity of steel with any liquids (e.g., without submerging the quantity of steel in any liquids). For example, the thermal ballast may be alumina sand (e.g., 90-grit alumina sand) positioned within a furnace or within a heat-treatment apparatus comprising an insulated container lined internally with electrically-heated blankets (see FIG. 3 and accompanying description for greater detail), and the quantity of steel may be exposed to the second, lower temperature in the presence of the thermal ballast by at least partially surrounding the quantity of steel with the thermal ballast. More specifically, the quantity of steel may be exposed to the second, lower temperature in the presence of the thermal ballast by burying the quantity of steel in the thermal ballast. The thermal ballast may be preheated to the desired, second, lower temperature before the quantity of steel is exposed to the second, lower temperature.

After the heat treatment is complete, the quantity of steel may be permitted to cool, as shown at 110. For example, the quantity of steel may be removed from the environment in which the second, lower temperature was maintained (e.g., a furnace) and permitted to air-cool (e.g., without active airflow cooling other than normal ventilation) until the quantity of steel reaches room temperature. After the quantity of steel cools to room temperature, a martensite phase may form within the bainitic steel material 100 (see FIG. 1) in addition to the bainite phase and the retained austenite phase. The resulting quantity of steel may be a bainitic steel material 100 as described previously in connection with FIG. 1.

Figure 3:
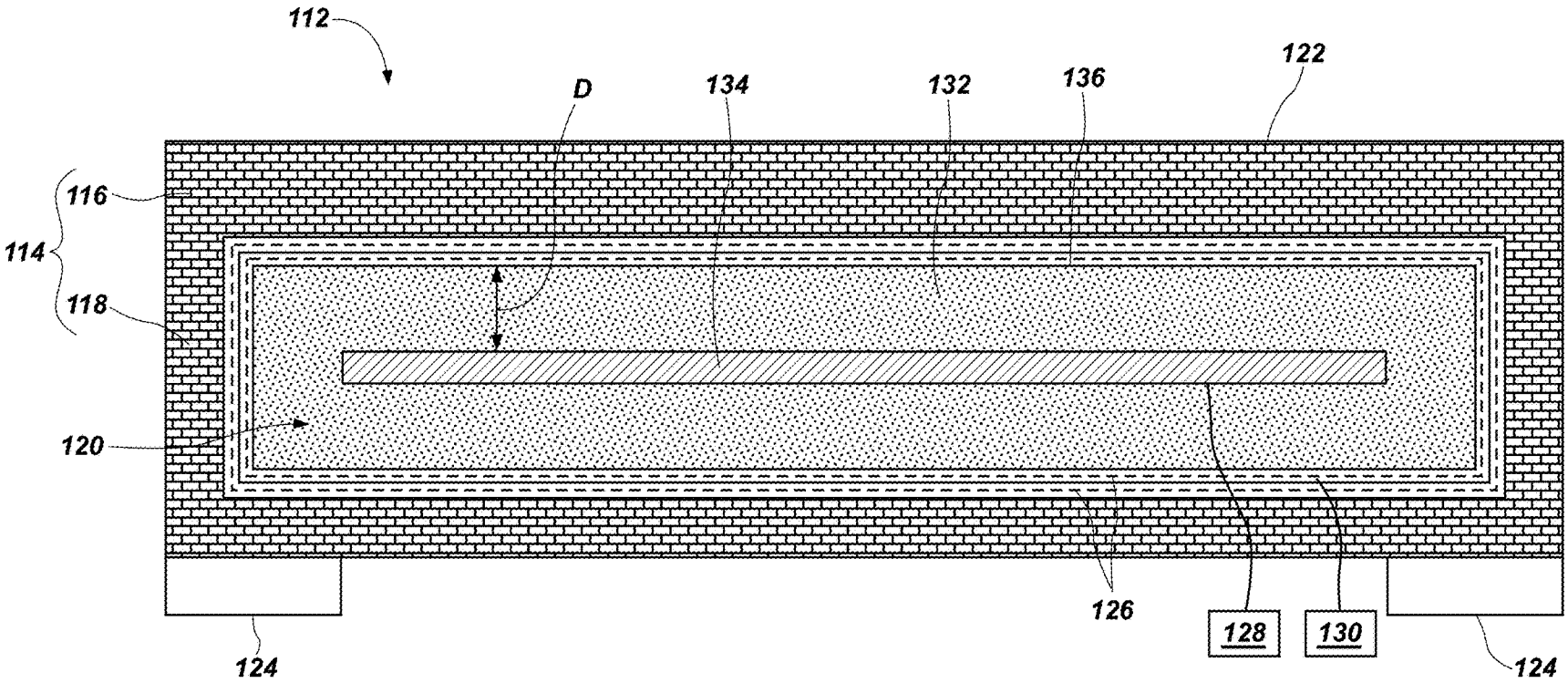
FIG. 3 is a cross-sectional schematic of a heat-treatment apparatus for forming the bainitic steel material of FIG. 1.

FIG. 3 is a cross-sectional schematic of heat-treatment apparatus 112 for forming the bainitic steel material 100 of FIG. 1. The heat-treatment apparatus 112 may be configured such that at least acts 106 through 110 of the method 102 described in connection with FIG. 2 may be performed within the heat-treatment apparatus 112. The heat-treatment apparatus 112 may include, for example, a container 114 sized and shaped to support therein equipment and materials for forming the bainitic steel material 100 of FIG. 1. The container 114 may include a removable lid 116 granting selective access to an interior of the container 114. The container 114 may include a receptacle 118 defining a cavity 120 sized and shaped to contain equipment and materials for forming the bainitic steel material 100 of FIG. 1. The container 114 may be at least partially formed from, for example, insulation bricks, such as, for example, bricks of refractory material.

In some embodiments, at least the exterior surfaces of the container 114 may be covered with a liner 122, which may be, for example, stainless steel, to protect the materials of the container 114 from the environment or from impacts with handling equipment. For example, each surface of the container 114, including the exterior and interior surfaces of the lid 116 and the receptacle 118 may be covered with the liner 122. In some embodiments, the container 114 may include handling structures 124, which may be positioned and shaped to enable handling equipment to interact with (e.g., to pick up and move) the container 114. Forexample, the handling structures 124 may be forklift prong receivers located on an underside of the container 114 opposing the lid 116.

The heat-treatment apparatus 112 may include at least one heating blanket 126 located within the cavity 120 of the container 114. For example, multiple heating blankets 126 may be positioned on interior walls of the lid 116 and the receptacle 118 defining the cavity 120. More specifically, the heating blankets 126 may line each interior wall of the lid 116 and the receptacle 118 defining the cavity 120, such that the heating blankets 126 surround the remaining portion of the cavity 120 located within the heating blankets 126. The heating blankets 126 may be electrically powered, may be configured to heat the contents of the container 114 to the temperatures described previously in connection with act 106 of FIG. 2, and may be configured to control cooling of the contents of the container 114 as described previously in connection with act 110 of FIG. 2. Suitable heating blankets 126 are commercially available from, for example, HTS/Amptek of Stafford, Tex., USA. The selective heating and refraining from heating performed by the heating blankets 126 may be controlled by one or more heat sensors 128 (e.g., one located on a workpiece 134 and one located within a thermal ballast 132) and a programmable control unit 130 (e.g., including a processor) operatively connected to the heating blankets 126.

A thermal ballast 132 may be located within the cavity 120 of the container 114 on a side of the heating blankets 126 opposing the container 114, and a workpiece 134 of austenitized steel may be buried within the thermal ballast 132. The cavity 120 may be sized and shaped, and the quantity of thermal ballast 132 within the cavity 120 may be may be sufficient, such that at least some thermal ballast 132 may be located between the workpiece 134 and the heating blankets 126 on each side of the workpiece 134. For example, a minimum distance D between the workpiece 134 and the heating blankets 126 may be 1 inch or greater. More specifically, the minimum distance D between the workpiece 134 and the heating blankets 126 may be, for example, 3 inches or greater. In some embodiments, the thermal ballast 132 and the workpiece 134 may be located within a shell 136, which may be located between the thermal ballast 132 and the heating blankets 126. The shell 136 may be of, for example, an aluminum material.

As a result of the proximity of the heating blankets 126 to the thermal ballast 132 and the workpiece 134, the primary heating mechanism of the heat-treatment apparatus 112 may be conduction, rather than convection or radiation. For example, the workpiece 134 may primarily be exposed to the second, lower temperature described previously in connection with act 106 of FIG. 2 via heat conduction from the heating blankets 126, through the optional shell 136, through the thermal ballast 132, to the workpiece 134, rather than via convection utilizing a gas or radiation.

EXAMPLE

Figure 4:
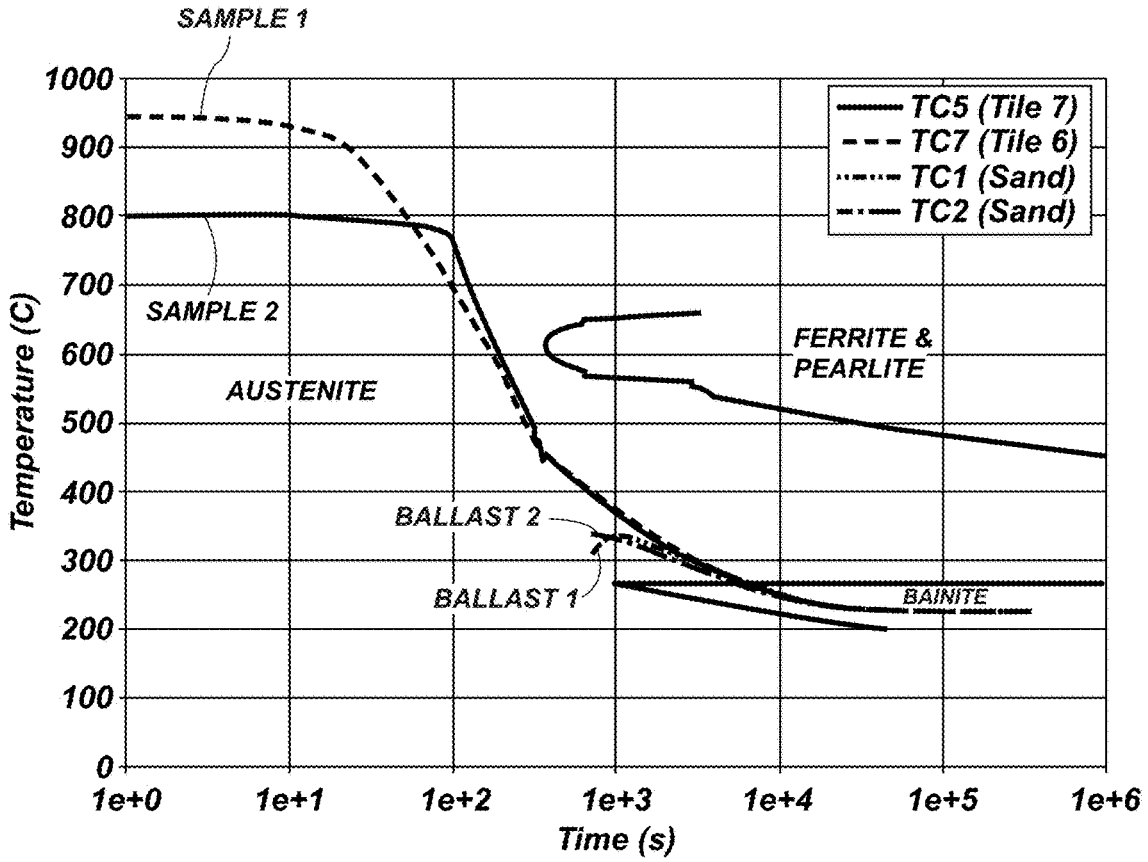
FIG. 4 is a time-temperature-transformation diagram overlaid over temperature curves measured during a heat treatment of a bainitic steel material.

Referring to FIG. 4, a time-temperature-transformation diagram overlaid over temperature curves measured during a heat treatment of a bainitic steel material is shown. The temperatures of two 4-inch by 4-inch by 0.75-inch plate of steel (i.e., SAMPLE 1 and SAMPLE 2, as labeled on the diagram) having a composition as described previously in connection with FIG. 1 were monitored using a thermocouple attached to each respective plate. Each plate was austenitized in a furnace, permitted to air-cool to between about 500° C. and about 400° C. (e.g., about 450° C.), and then buried in preheated, 90-grit alumina sand, which was also monitored using a thermocouple in each respective mass of ballast sand (BALLAST 1 and BALLAST 2 on the diagram) in a furnace at about 225° C., as shown in the diagram from time 0 seconds to between time $10^2$ seconds and $10^3$ seconds. As shown at about time $10^3$ seconds, the peak temperature of the thermal ballasts was between about 330° C. and about 340° C. The plates of steel entered the bainite phase formation region and remained in the bainite phase formation region by remaining exposed to the second, lower temperature of 225° C. for about 4 days. The plates of steel were then removed from the furnace and permitted to air-cool to room temperature.

The resulting bainite steel material was tested for its material properties, which were as described previously in connection with FIG. 1. In addition, the resulting bainite steel material was tested for ballistic performance. The hardness and strength of the plates were found to be similar to S41600 Steel Alloy. The resulting bainite steel material may be useful in many applications benefitting from at least substantially uniformly hard, strong, yet ductile materials, such as, for example, armor plating and wear plating.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A method of making a bainitic steel, comprising:

austenitizing a quantity of steel by exposing the quantity of steel to a first temperature in a furnace, a composition of the quantity of steel being configured to impede formation of non-bainite ferrite, pearlite, and Widmanstätten ferrite;

permitting the quantity of steel to cool in air within the furnace to a second, lower temperature;

after permitting the quantity of steel to cool, heat-treating the quantity of steel to form bainite by exposing the quantity of steel to a third, still lower temperature;

stabilizing the second, lower temperature by exposing the quantity of steel to the third, still lower temperature within an enclosed container distinct from the furnace while the quantity of steel is surrounded in a thermal ballast consisting of solid, stationary particles enclosed within the container; and permitting the quantity of steel to cool.

2. The method of claim 1, further comprising homogenizing the quantity of steel by exposing the quantity of steel to a temperature greater than about 1,000° C. before austenitizing the quantity of steel.

3. The method of claim 1, wherein austenitizing the quantity of steel by exposing the quantity of steel to the first temperature comprises exposing the quantity of steel to a temperature of about 1,000° C.

4. The method of claim 1, wherein austenitizing the quantity of steel, the composition of the quantity of steel being configured to impede formation of non-bainite ferrite, pearlite, and Widmanstatten ferrite, comprises austenitizing the quantity of steel, the composition of the quantity of steel being between 0.62% and 0.78% by weight carbon, between 1.5% and 2.5% by weight silicon, between 1.75% and 2.5% by weight manganese, between 0.22% and 0.5% by weight molybdenum, between 1.0% and 1.8% by weight chromium, between 0.0% and 0.3% by weight cobalt, between 0.25% and 1.0% by weight aluminum, and the balance consisting essentially of iron.

5. The method of claim 4, wherein austenitizing the quantity of steel comprises austenitizing the quantity of steel, the quantity of steel being free of nickel.

6. The method of claim 1, wherein heat-treating the quantity of steel comprises maintaining the quantity of steel exposed to the third, still lower temperature for 2 days or more.

7. The method of claim 6, further comprising maintaining the quantity of steel exposed to the third, still lower temperature for at least 4 days.

8. The method of claim 1, wherein exposing the quantity of steel to the third, still lower temperature comprises exposing the quantity of steel to a temperature of between 200° C. and 300° C.

9. The method of claim 1, wherein exposing the quantity of steel to the third, still lower temperature within the enclosed container while the quantity of steel is surrounded in the thermal ballast consisting of the solid, stationary particles, enclosed within the container comprises burying the quantity of steel within pre-heated alumina when exposing the quantity of steel to the third, still lower temperature.

10. The method of claim 9, wherein permitting the quantity of steel to cool after stabilizing third, still lower temperature comprises air-cooling the quantity of steel.

* * * * *